US008853598B2

(12) United States Patent
Ott

(10) Patent No.: US 8,853,598 B2
(45) Date of Patent: Oct. 7, 2014

(54) BOWLING BALL MAINTENANCE DEVICE

(76) Inventor: Wylie Ott, Vancouver, WA (US)

( * ) Notice: Subject to any disclaimer, the term of this patent is extended or adjusted under 35 U.S.C. 154(b) by 0 days.

(21) Appl. No.: 13/608,661

(22) Filed: Sep. 10, 2012

(65) Prior Publication Data

US 2013/0340792 A1 Dec. 26, 2013

Related U.S. Application Data

(60) Provisional application No. 61/533,081, filed on Sep. 9, 2011.

(51) Int. Cl.
*H05B 1/02* (2006.01)

(52) U.S. Cl.
USPC ..... 219/521; 219/492; 219/507; 219/494; 392/418; 134/40; 134/105

(58) Field of Classification Search
CPC ..... H05B 1/02; H05B 1/00
USPC ..... 219/492, 494, 497, 596, 507, 521; 392/416–418; 134/6, 7, 40, 105
See application file for complete search history.

(56) References Cited

U.S. PATENT DOCUMENTS

| | | | | |
|---|---|---|---|---|
| 1,500,681 | A | | 7/1924 | Mudra |
| 2,195,303 | A | | 3/1940 | Haskins |
| 2,338,547 | A | | 1/1944 | Sheldon |
| 2,339,573 | A | | 1/1944 | Knipp |
| 2,405,344 | A | | 8/1946 | Cloutier |
| 2,420,988 | A | | 5/1947 | Tholen |
| 2,469,948 | A | | 5/1949 | Bune |
| 2,572,464 | A | | 10/1951 | Freitas |
| 2,575,814 | A | | 11/1951 | Jankowski |
| 2,588,714 | A | | 3/1952 | Fleming |
| 2,617,012 | A | * | 11/1952 | Westley ..... 219/385 |
| 2,624,898 | A | | 1/1953 | Newswanger |
| 2,656,557 | A | | 10/1953 | Vargo |
| 2,733,464 | A | | 2/1956 | Le Mieux |
| 2,831,205 | A | | 4/1958 | Ernst |
| 2,907,059 | A | | 10/1959 | Cornett |
| 2,960,337 | A | | 11/1960 | Johnson |
| 2,980,935 | A | | 4/1961 | Bogard et al. |
| 3,016,553 | A | | 1/1962 | Wilhelm et al. |
| 3,086,233 | A | | 4/1963 | Knott |
| 3,091,681 | A | | 5/1963 | Mayer |
| 3,103,677 | A | | 9/1963 | Gallant |
| 3,104,408 | A | | 9/1963 | Szymanowski |
| 3,150,392 | A | | 9/1964 | Molander |
| 3,249,957 | A | | 5/1966 | Secord |

(Continued)

*Primary Examiner* — Mark Paschall
(74) *Attorney, Agent, or Firm* — Marger Johnson & McCollom, P.C.

(57) ABSTRACT

A bowling ball maintenance device performs a de-oiling process on bowling balls having porous surfaces. The maintenance device may comprise a container sized to store at least one bowling ball within the container and structured to receive the bowling ball. A heating element is structured to warm an internal environment of the container at least to a level at which oil that may have accumulated in the pores of the ball begins to flow out of the pores. Embodiments also include a ball support cup within the container that is structured to contain the oil that has flowed out of the pores of the ball. Depending on the embodiment, the ball support cup may include three or more ball support extensions structured to support the ball in a stationary position over a height of the walls or edges of the ball support cup during operation of the maintenance device.

12 Claims, 7 Drawing Sheets

(56) References Cited

U.S. PATENT DOCUMENTS

| | | | | |
|---|---|---|---|---|
| 3,289,354 | A | 12/1966 | Stevens et al. | |
| 3,341,982 | A | 9/1967 | Torresen | |
| 3,355,756 | A | 12/1967 | Casbarro | |
| 3,371,365 | A | 3/1968 | Falckenberg | |
| 3,402,415 | A | 9/1968 | Berlin | |
| 3,451,088 | A | 6/1969 | Germann | |
| 3,460,179 | A | 8/1969 | Falckenberg et al. | |
| 3,624,346 | A * | 11/1971 | Guth | 219/201 |
| 3,758,912 | A | 9/1973 | Shibuya et al. | |
| 4,140,893 | A * | 2/1979 | Renteria | 219/385 |
| 4,192,034 | A | 3/1980 | Knepper, Jr. | |
| 4,343,990 | A * | 8/1982 | Ueda | 219/492 |
| 4,567,618 | A | 2/1986 | Picchietti, Sr. | |
| 5,484,329 | A | 1/1996 | Engelbrektson | |
| 5,598,597 | A | 2/1997 | Templeton | |
| 5,811,763 | A * | 9/1998 | O'Rorke | 219/411 |
| 8,481,895 | B2 * | 7/2013 | Taylor et al. | 219/521 |
| 2002/0168925 | A1 | 11/2002 | Klukos | |
| 2003/0178404 | A1 * | 9/2003 | DiMartino et al. | 219/386 |
| 2005/0011542 | A1 * | 1/2005 | Hickland et al. | 134/40 |
| 2013/0133706 | A1 * | 5/2013 | Bae | 134/105 |

* cited by examiner

BOWLING BALL MAINTENANCE DEVICE

PRIORITY CLAIM

This application claims benefit of and is a non-provisional application of U.S. Provisional Application No. 61/533,081, filed Sep. 9, 2011, the contents of which are incorporated herein.

FIELD OF THE INVENTION

This disclosure relates generally to device for use with bowling balls, and more particularly to a device that is structured to clean and maintain bowling balls.

BACKGROUND

Modern bowling balls are typically made of a urethane shell with a resin coating. Although the shell normally appears solid at a distance, its surface is usually porous when viewed close-up or microscopically. This shell surface porosity gives the ball a higher coefficient of friction than would be expected of an object that generally feels and appears to be smooth. This friction allows the ball to "grip" the lane, causing the ball to "hook"—that is, change direction due to spin imparted to the ball by a bowler's delivery, imbalance in the core of the ball, or both.

Since early in the twentieth century, the practice of oiling bowling lanes has been universal. Originally intended to reduce the wear and tear on the wooden lanes that occurred from repeated play, now the application of oil in patterns is often used to make it easier (or more difficult) to achieve high scores. Most bowling establishments strip old oil off the lanes and re-oil at least once a day, or occasionally more often.

Dust, dirt, and other foreign debris inevitably settle out of the air onto the oil on the lane, and, as balls roll or slide through the oil, the pores on the surface of the balls become clogged or filled with an oil-and-dirt mixture. After a ball has been used for some time, ball performance will change, usually considered a negative change, due to the friction coefficient of the ball surface changing as the pores of the shell surface become clogged with dirt and oil.

U.S. Pat. No. 5,811,763 entitled BOWLING BALL REJUVENATOR (hereinafter "the '763 patent") describes a device commonly known as or related to a "Rejuvenator" device that is used in some bowling establishments. As set out in the '763 patent, the Rejuvenator works by heating a rotating bowling ball from one side to remove the oil-dirt mixture. In some models a ball wiper or oil vacuum is used to remove the oil from the ball once the oil-dirt mixture has beaded to the ball surface of the heating ball. While the Rejuvenator is effective at cleaning bowling balls, it is exceedingly expensive due to the complicated set up of the rotating motor and heating element requirements. Further, the Rejuvenator is most effective at cleaning the areas of the bowling ball that come in close proximity to the heating element. Because the heating element is located to the side of the ball, the sides of the ball are subject to a more aggressive heat treatment than the top and bottom of the ball. Thus, the ball must be run through the Rejuvenator in multiple orientations or for a relatively long time for it to effectively clean the entire bowling ball, otherwise it has areas with varying amounts of oil and dirt on its shell surface after treatment.

Embodiments of the invention address these and other limitations of the prior art.

SUMMARY

The present description gives instances of bowling ball maintenance devices, and methods, the use of which may help overcome problems and limitations of the prior art.

In particular, embodiments of the present concept are directed to bowling ball maintenance devices that controllably heat air surrounding an enclosed bowling ball to extract oil and other contaminants lodged in pores in the surface of the ball.

In some embodiments, a bowling ball maintenance device includes a housing having a ball chamber configured to enclose a bowling ball while the ball rests on a ball support. A processor controls a heating element to heat air within the maintenance device, and controls a circulation device to circulate the air around the enclosed ball. User controls on the housing allow a user to operate the maintenance device in a desired manner.

An advantage over the prior art is that the bowling ball can be cleaned of oil and contaminants in a consistent and efficient manner without risk of damage to the ball or the need to manipulate the ball during cleaning. Additionally, some embodiments of this concept can be manufactured and sold for prices that are affordable for home use for most bowlers.

These and other features and advantages of this description will become more readily apparent from the following Detailed Description, which proceeds with reference to the drawings, in which:

DETAILED DESCRIPTION

As described herein, embodiments of this concept are directed to a bowling ball maintenance device that removes oil and other particulates that accumulate in the porous surface of better bowling balls. The device includes a heating element, a fan, and a ball holding device inside a housing that includes user inputs, such as a timer, setting input, and/or power switch. The device may operate at temperatures of between about 100° F. to 160° F., and preferably between approximately 120° F. to 140° F. for constant temperature operations, described in more detail below. In general, the device operates by heating and circulating air around a bowling ball placed in the housing. The heat causes the accumulated oil to liquefy and flow out of the pores of the surface of the ball. A basin or cup at the bottom of the housing is structured to support the ball and may capture excess oil and debris as they are removed from the ball.

Embodiments are now described in more detail.

Figure 1:
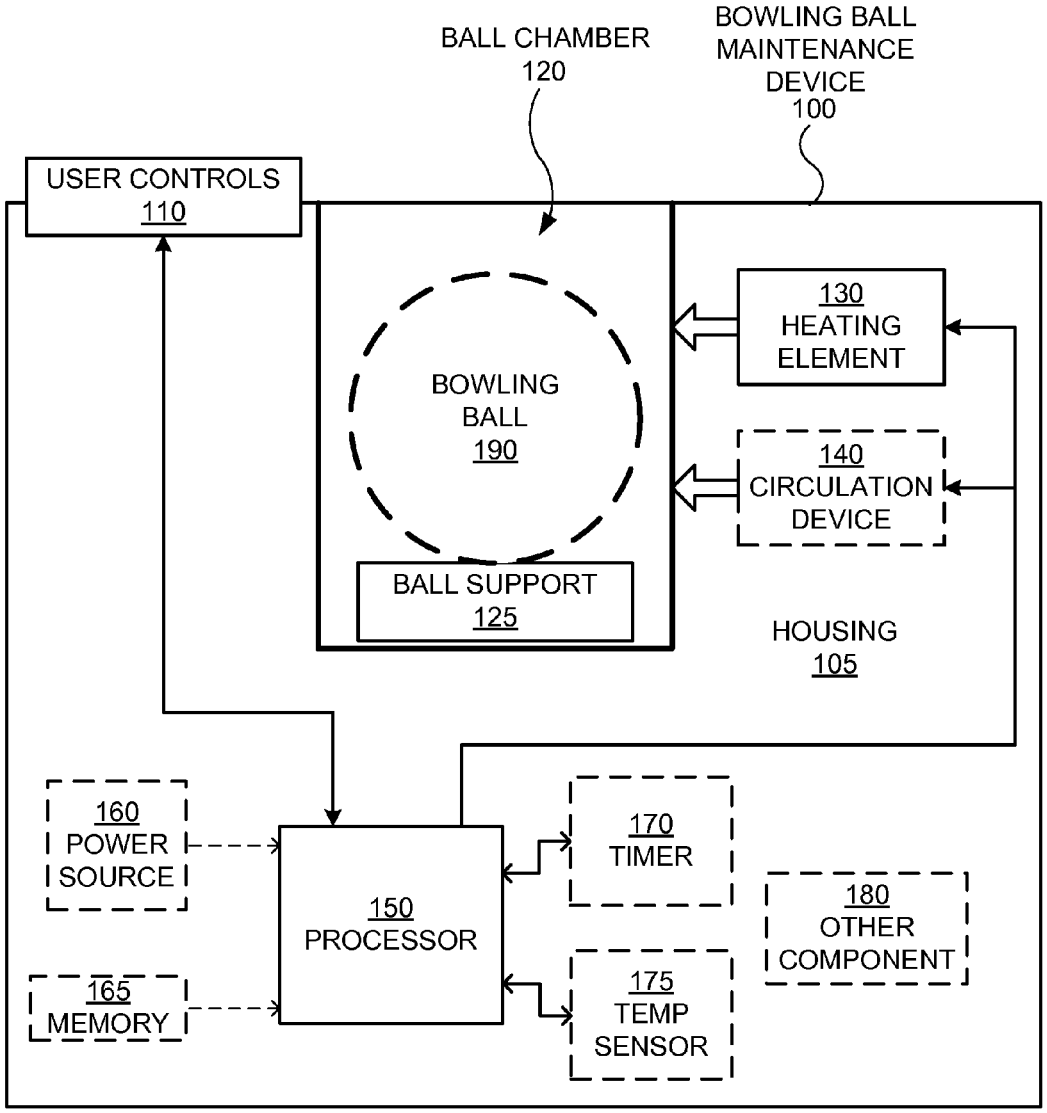
FIG. 1 is a functional block diagram of a bowling ball maintenance device according to embodiments of the invention.

FIG. 1 is a functional block diagram of a bowling ball maintenance device 100 according to embodiments of the invention. Referring to FIG. 1, the maintenance device 100 includes a housing 105 having a ball chamber 120 that is structured to enclose a bowling ball 190. A bowling ball 190 placed in the ball chamber 120 is held in place by a ball support 125. User controls 110 are included on the exterior of the housing 105 to allow a user to operate various functions of the maintenance device 100. In some embodiments these user controls communicate with a processor 150 that controls the operation of the maintenance device 100. In other embodiments the controls may work without requiring use of a processor. The maintenance device 100 also includes a heating element 130 and a circulation device 140, both of which are connected to, and controlled by, the processor 150.

In operation, the heating element 130 is controlled to heat air in the device to a desired temperature and the circulation device 140 causes the heated air to be circulated around a ball 190 that is placed in the ball chamber 120 of the device 100. The circulation of air is preferably a forced convection that maintains the air in the ball chamber at a consistent desired temperature without directly exposing a portion of the ball 190 to heat source. That is, with the device described above with reference to the '763 patent, portions of a bowling ball are directly adjacent to a heat source, which can overheat and potentially damage the surface of the bowling ball. Embodiments of this concept, on the other hand, heat air within the maintenance device 100, and circulate the heated air around the bowling ball to provide a gentle and consistent supply of heat. The heated air is by nature also low in humidity. The heated air liquefies the hardened oil in the surface pores of the bowling ball 190 and increases its ability to flow, which causes the liquefied oil to flow out of the pores along with the dirt and other contaminants that may also be stuck in the pores with the oil.

The ball support 125 may be structured, as described in more detail below, to allow the heated air to circulate under the bowling ball 190 and also to collect the oil and dirt that flow off of the ball during the maintenance process. The ball support 125 is also removable so that the excess oil and dirt can be easily disposed of, and the ball support can be cleaned.

The heating element 130 may include a resistance style heating element, an infrared heating element, or any other type of heating element that can controllably heat air to a desired temperature. In some embodiments, the heating element may be generally circular and have a diameter greater than the diameter of a bowling ball. In other embodiments, there may be two heating elements—one positioned below the ball in the housing and one positioned above the ball in the housing to consistently heat the air. The circulation device 140 may include a fan, an ionic potential plate system, or any other suitable system that forces air to flow at a desired rate. In some embodiments the heated air may flow adequately by convection. In those environments no circulation device 140 is necessary to be included.

The maintenance device 100 may optionally include a power source 160, a memory 165, a timer 170, a temperature sensor 175, and/or other components 180. The power source 160 may be a converter that transforms AC power from a household plug into DC power needed by the processor 150. Alternatively, the power source 160 may include a rechargeable battery or a battery compartment for one-time-use batteries in order to make the maintenance device 100 portable. The memory 165 may be connected to the processor 150 and store firm ware, software, or other operating instructions needed to operate the device. In addition, the memory 165 may record temperature profiles for operating intervals for calibration purposes, test purposes, or optimal operation setting determinations. For example various profiles may be simultaneously stored in the memory 165 that are selected depending on how dirty the bowling ball 190 is. For instance, the operation may choose to provide a heavily soiled bowling ball 190 with a particular profile that runs longer or hotter than one for a lightly soiled ball. Various profiles may also be stored depending on the particular type of lane oil used.

The timer 170 may be used to track time intervals for operation of the device 100. For example, if the user controls 110 include a timer dial, or other timer setting, the timer 170 may track elapsed time and notify the processor when a requested amount of time has passed. Temperature sensor 175 may include a thermocouple or thermometer that measures the air temperature in one or more areas of the ball chamber 120, or other portion of the device 100, so that the temperature of the air circulating around the ball can be maintained within a desired range. The processor 150 may use temperature measurements supplied by the temperature sensor 175 to control operations of the heating element 130 and the circulation device 140. Optional component 180 may include other components of the device such as a humidity regulator to reduce the humidity of the air in the device.

Although only a single bowling ball 190 is shown in the ball chamber 120 of FIG. 1, various other embodiments may be able to enclose and clean multiple bowling balls simultaneously. In these multi-ball embodiments, multiple balls 190 may be enclosed in a single common ball chamber 190 or in separate ball chambers. When the balls 190 are enclosed in a single common chamber, multiple ball supports 125 may be used to support the balls or a single ball support that is structured to hold multiple balls may be used.

Figure 2A:
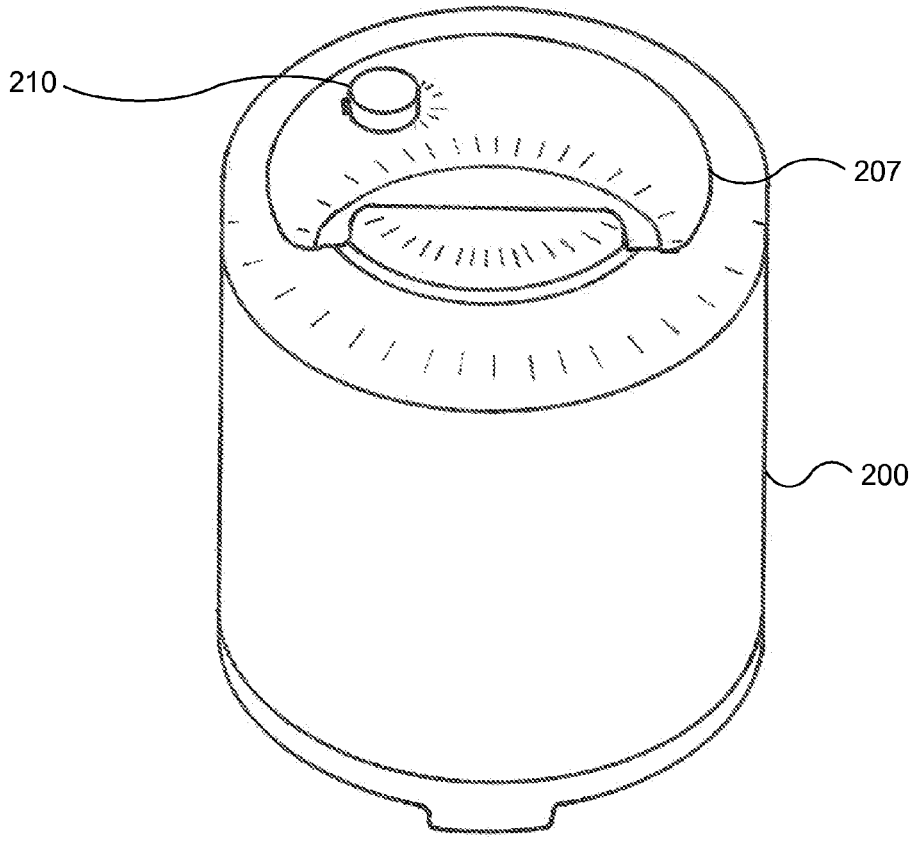
FIGS. 2A, 2B, and 2C are diagrams of an example bowling ball maintenance device showing exterior views of the device according to embodiments of the invention.
Figure 2B:
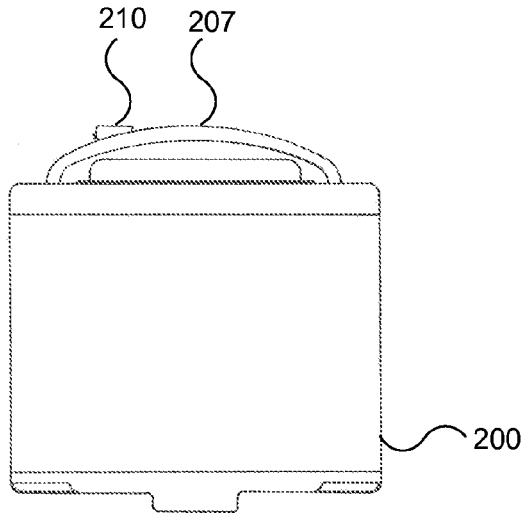
Figure 2C:
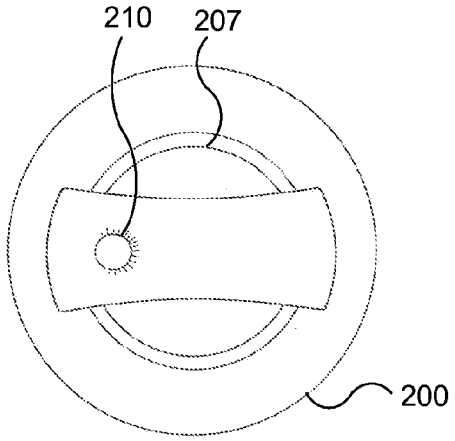

FIGS. 2A, 2B, and 2C are diagrams of an example bowling ball maintenance device 200 showing exterior views of the device according to embodiments of the invention. Referring to FIGS. 2A-2C, the device 200 may be substantially cylindrical, and include a lid 207 that covers the ball chamber 120 (FIG. 1). User controls 210 on the device may include a timer knob that can be twisted to a desired set time by the user. Labels around the timer knob may indicate approximate time intervals that the timer may be set to. For example, the labels for these time intervals may include 30 minutes, 60 minutes, 90 minutes, and 120 minutes. The timer knob 210 can be dialed to a desired time interval, e.g., 60 minutes, and the device 200 will run for that amount of time, e.g., one hour, before shutting itself off. As described above, this auto-shut off feature may prevent the ball from being damaged or the device from being run longer than is necessary. Some simple embodiments may have the user controls 210 coupled directly to the heating element 130, without requiring use of a processor 150.

Figure 3A:
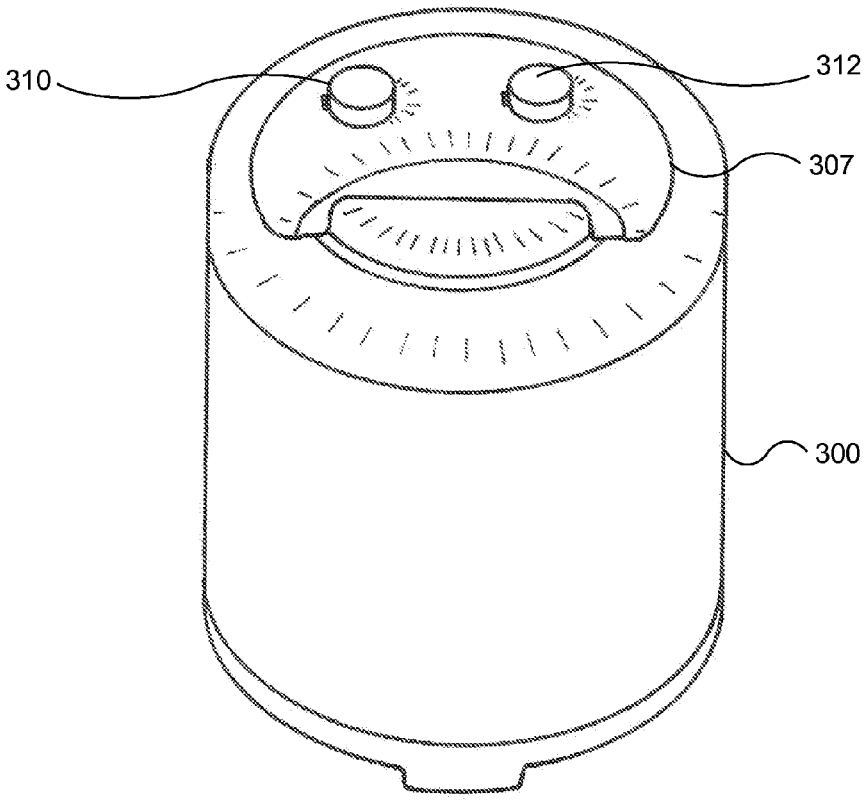
FIGS. 3A, 3B, and 3C are diagrams of an example bowling ball maintenance device showing exterior views of the device according to other embodiments of the invention.
Figure 3B:
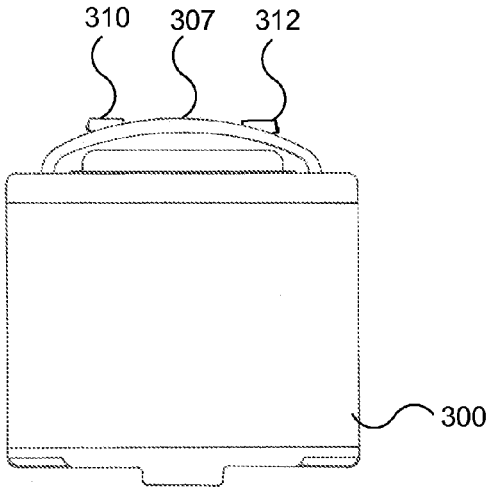
Figure 3C:
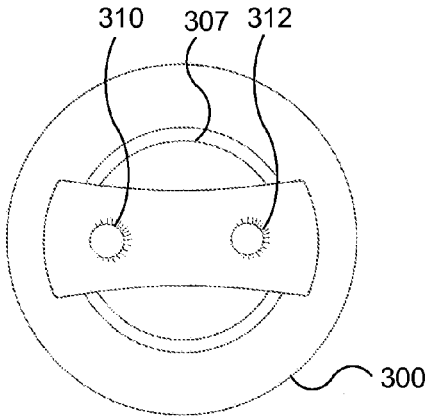

FIGS. 3A, 3B, and 3C are similar to the 2A, 2B, and 2C counterparts, except there are separate user controls 310, 312, to respectively control an operation time and an operation temperature. As above, the controls 310, 312 may be coupled to the processor 150, or may be directly coupled to a dedicated timer and dedicated temperature control, for example. Additional user controls are possible, of course, such as a fan speed control (not illustrated).

Figure 4A:
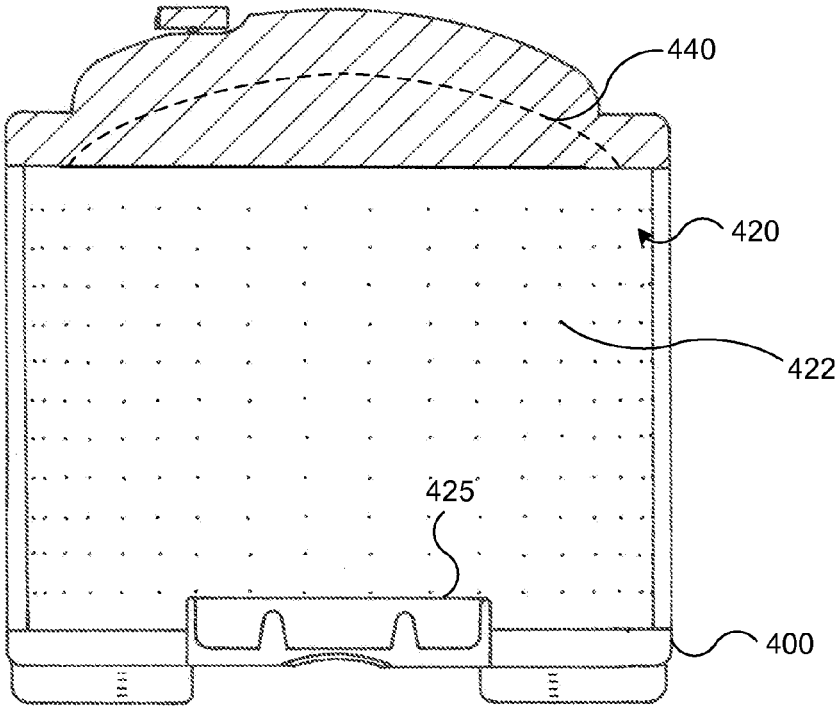
FIGS. 4A and 4B are diagrams of an example bowling ball maintenance device showing interior views of the device according to embodiments of the invention.
Figure 4B:
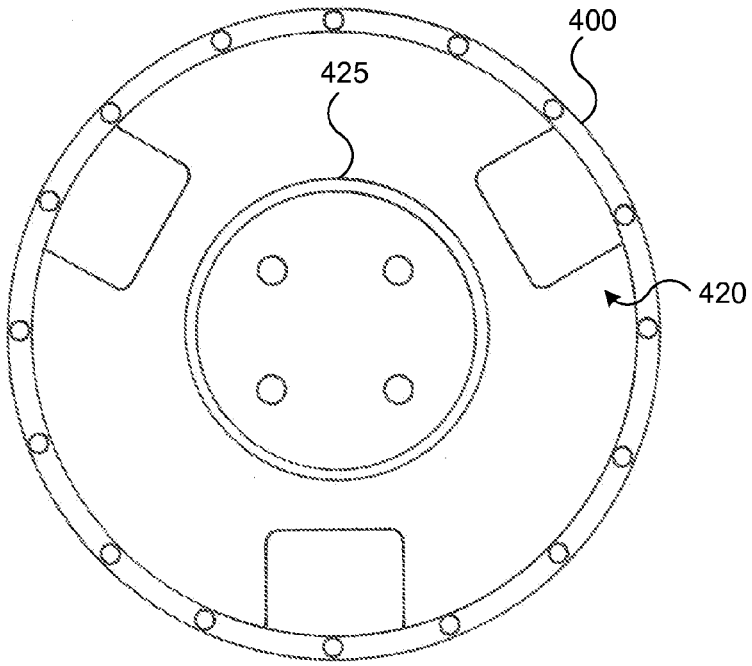

FIGS. 4A and 4B are diagrams of an example bowling ball maintenance device 300 showing interior views of the device according to embodiments of the invention. Referring to FIGS. 4A and 4B, the device includes a ball chamber 420 and ball support 425. The ball chamber 420 may also be substantially cylindrical. It may include a domed lid structure, such as illustrated at 440. Multiple air holes 422 may be formed in the walls of the ball chamber 420 to allow the heated air to be circulated around a ball placed in the chamber. For example, the circulation device 140 (FIG. 1) may force heated air in the top of the chamber 420 over the ball and the air may escape through the multiple air holes 422 formed in the wall of the chamber to be reheated by the heating element 130 (FIG. 1) and circulated back over the top of the ball. In other embodiments, the multiple air holes 422 may be used to force heated air into the chamber 420 and an exhaust port at the top and/or bottom of the chamber may be used recapture the air for recirculation. While recirculating the majority of the heated air improves efficiency, in some embodiments, fresh air from outside the device may be taken in and heated during operation of the device, so that evaporated water vapor or oil in the recirculated air does not interfere with operation of the device 400.

Figure 5A:
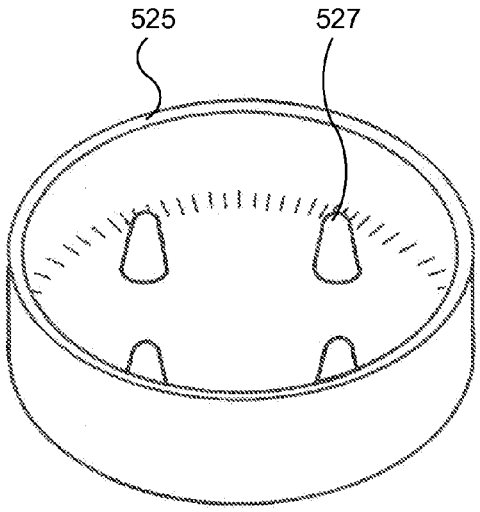
FIGS. 5A, 5B, and 5C are diagrams of an example ball holder for a bowling ball maintenance device according to embodiments of the invention.
Figure 5B:
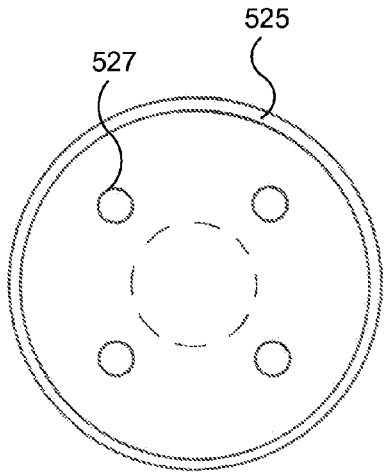
Figure 5C:
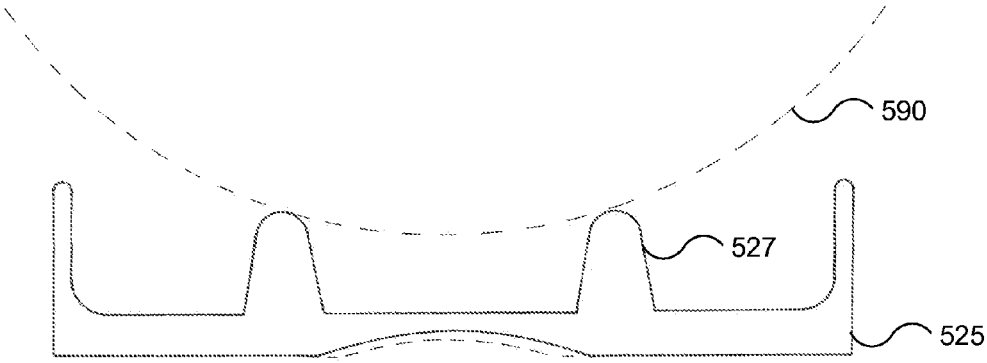

FIGS. 5A, 5B, and 5C are diagrams of an example ball holder for a bowling ball maintenance device according to embodiments of the invention. Referring to FIGS. 5A-5C, the bowling ball support device 525 may be a hard rubber or plastic cup with multiple ball posts 527 to hold the ball 590 above the bottom of the cup. Four posts 527 are illustrated in FIGS. 5A and 5B, although any number of posts operative to support a ball may be used. The posts 527 of FIG. 5A are shown as having a rounded, generally conical shape, but may include other shapes to support the ball as well. The posts 527 allow heated air to circulate under the ball 590 and also keep the ball above excess oil and dirt that may collect in the ball support cup 525 during a maintenance operation. The contact area where the posts 527 interface with the surface of the ball is very small, which enhances cleaning of the ball. The rubber or plastic material of the cup may be easy to clean while not damaging the ball surface, although any type of suitable material may be used in the construction of the ball support device 525. The ball support 525 is also removable from the device so that the excess oil and dirt that accumulate in the cup portion can be easily disposed of, and the support device can be cleaned. Similarly, the posts 527 may also be removable from the ball support 525, for example to replace them due to wear. In some embodiments, the posts 527 may be made of a different material than the ball support 525.

In an exemplary embodiment the ball support device 525 may be about five to six inches in diameter with substantially vertical sidewalls of about an inch tall. Four posts 527, for example made from rubber, are included to support a ball 590, where the posts are about ¾ of an inch tall and spaced approximately two inches apart. The posts 527 may have rounded tops and are sturdy enough to support a 16 pound bowling ball 590 without any deformation.

Figure 6:
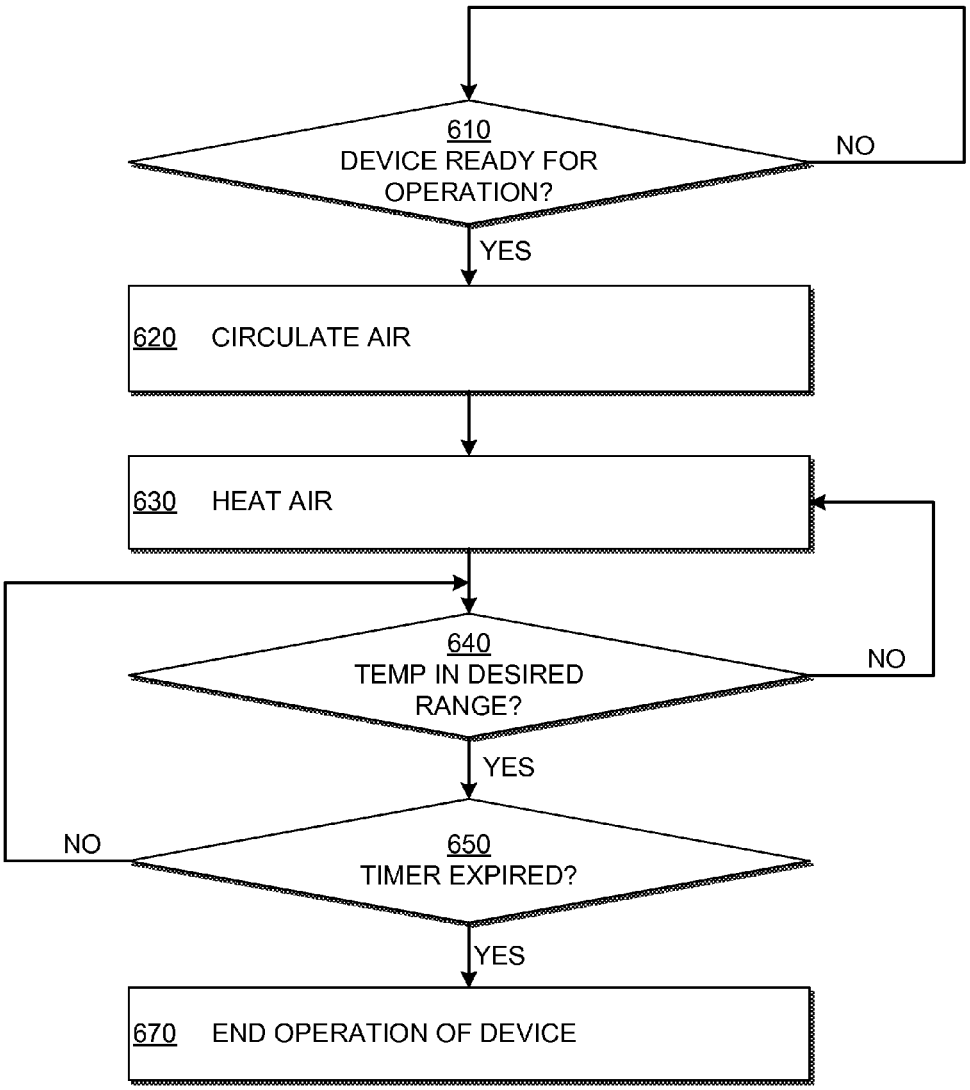
FIG. 6 is a flow diagram of a method of operating a bowling ball maintenance device according to embodiments of the invention.

FIG. 6 is a flow diagram of a method of operating a bowling ball maintenance device according to embodiments of the invention. Although steps and processes are shown in a particular order in FIG. 6, these steps may be performed in an alternate order. Further, additional processes may be carried out that are not shown in this figure. Referring to FIG. 6, the method begins with process 610 where it is determined if the device is ready for operation. The device may be ready for operation when a bowling ball has been placed in the ball chamber of the device, the lid has been closed and secured, and the user controls have been set to a desired operation setting. Once it is determined that the device is ready for operation, the method proceeds to process 620 where the air in the device is circulated. This process may include initiating operation of the circulation device. The air is also heated in process 630, where the heating element in the device may be initiated.

The method then proceeds to process 640 where it is determined if the air temperature is in a desired range. If the air has not reached a desired temperature the method may return to process 630 where the air is continually heated. Here, the heating element may be initially turned on to a "high" setting to quickly heat the air to a desired temperature, e.g., 130 degrees Fahrenheit. Once it is determined that the air is at a desired temperature, the heating element may be switched off, or switched to a "low" setting to maintain the desired temperature of the air. If it is determined in process 640 that the temperature has fallen below a predefined threshold level, the heating element may again be switched to the "high" setting to reheat the air back to a desired temperature. In some embodiments, the range for acceptable air temperatures is 128 degrees F. to 132 degrees F. Thus, when the temperature falls below 128 degrees F., the heating element heats the air for a set amount of time, or until the air reaches 132 degrees F.

In process 650 it is determined if a set timer has expired. Here, it is determined whether a set desired time has elapsed for operation of the device. If, for example, a user had set a timer dial to "60 minutes," it is determined in process 650 if an hour has elapsed. When the time has elapsed, the method proceeds to process 670 where operation of the device is ended. Here, the circulation device and heating element may be turned off. Additionally, an indication light may be displayed on the user interface or a sound may be emitted signaling that the ball has been cleaned. Alternatively, the device may cease operation if the user shuts off the device or power is loss.

Figure 7:
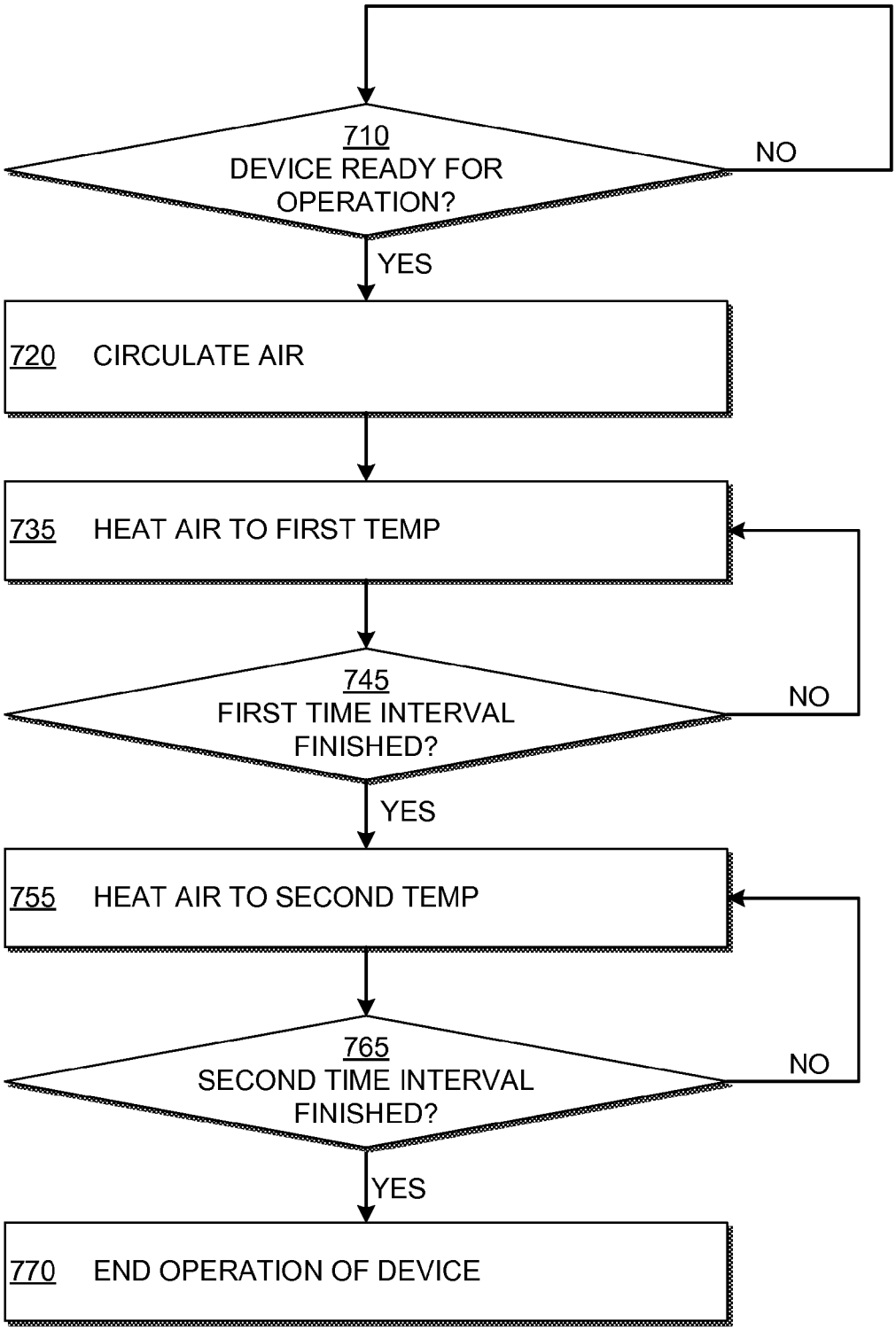
FIG. 7 is a flow diagram of another method of operating a bowling ball maintenance device according to embodiments of the invention.

FIG. 7 is a flow diagram of another method of operating a bowling ball maintenance device according to embodiments of the invention. Referring to FIG. 7, the method begins with process 710 where it is determined if the device is ready for operation. This process may include similar steps to process 710 described above. In process 720, the air in the device is circulated, and in process 735, the air is heated to a first temperature. Here, the heating element may be operated to heat the air to a first desired temperature. In process 745, it is determined if a first time interval has elapsed. That is, the air in the device is heated to a first desired temperature for a first time interval in processes 735 and 745. Although not shown, this method may also include a process similar to process 640, where it is determined whether the first temperature is being maintained in a desired range.

After the first time interval has elapsed, the air in the device is heated to a second desired temperature in process 755. Here, the second desired temperature may be higher or lower than the first desired temperature. If the second temperature is higher than the first temperature, the heating element may be turned to a "high" setting to increase the temperature of the air. If the second temperature is lower than the first temperature, the heating element may be turned off and/or outside air may be taken on to lower the temperature of the air to the second desired temperature. In process 765, it is determined if a second time interval has elapsed, where the air is at the second desired temperature. After the second time interval has elapsed, the operation of the device is ended in process 770. Although only two temperature levels are shown in FIG. 7, additional temperature levels and intervals may be present in other methods.

In one embodiment, the device is operable to heat the air, and by association the surface of the ball and the oil in the pores of the ball surface to multiple levels as follows. The air is initially heated to 140° F. for 5 minutes, followed by a reduction in temperature to 130° F. for 5 minutes, followed by alternating periods of 120° F. and 135° F. increments for a total of 50 minutes. This hour long cleaning process may hasten oil removal without damaging the surface of the bowling ball. That is, the initial high temperatures cause the oil to quickly boil without harming the material in the ball surface, while the alternating temperature periods allow the oil to flow easily without raising the temperature of the ball surface or core to levels that would harm the materials. This alternating heat process is more efficient at removing oil and dirt than constant temperature applications and hence can reduce the operation time needed for cleaning a bowling ball. Embodiments of the device may have user controls that allow a user to select a constant temp cleaning process or a "quick-clean" process that uses multiple temperature levels. Hence, a bowler may run a longer cleaning process overnight or when they are not planning on playing in the near future, but have the option to run a quick 20 or 30 minute "quick-clean" process right before heading out to play.

Some embodiments of the invention have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out herein.

What is claimed is:

1. A bowling ball maintenance device for performing a de-oiling process on a bowling ball, the maintenance device comprising:

a generally sealable container sized to store at least one bowling ball within the container and structured to receive the bowling ball, the bowling ball including a plurality of pores formed on a shell;

a heating element structured to warm an internal environment of the container between about 100° F. to 160° F. at which oil that may have accumulated in the pores of the ball begins to flow out of the pores; and a ball support cup placeable within the container and having a generally concave center portion and walls or edges structured to contain the oil that has flowed out of the pores of the ball, the ball support cup including three or more ball support extensions structured to support the ball in a stationary position over a height of the walls or edges of the ball support cup during operation of the maintenance device.

2. The bowling ball maintenance device of claim 1, further comprising:

an air circulation device structured to move heated air within the container and around the bowling ball.

3. The bowling ball maintenance device of claim 1, further comprising:

a user interface on an outside of the container and structured to receive input from an operator of the maintenance device.

4. The bowling ball maintenance device of claim 3 in which the user interface comprises a timer control.

5. The bowling ball maintenance device of claim 4 in which the user interface further comprises a temperature control.

6. The bowling ball maintenance device of claim 3, further comprising:

a processor coupled to the user interface and structured to control one or more operations of the maintenance device based on input received through the user interface.

7. The bowling ball maintenance device of claim 6, further comprising a memory coupled to the processor and structured to hold data for one or more pre-programmed processes of maintenance device operation.

8. The bowling ball maintenance device of claim 7 in which at least one of the pre-programmed processes, when implemented, causes the maintenance device to warm the internal environment of the container to a first temperature for at least a first time duration.

9. The bowling ball maintenance device of claim 8 in which the at least one of the pre-programmed processes, when implemented, further causes the maintenance device to change the internal environment of the container to a second temperature for a second duration immediately after having warmed the internal environment to first temperature for at least the first time duration.

10. The bowling ball maintenance device of claim 9 in which the second temperature is higher than the first temperature.

11. The bowling ball maintenance device of claim 9 in which the second temperature is lower than the first temperature.

12. The bowling ball maintenance device of claim 1 in which the heating element is structured to warm an internal environment of the container between about 120° F. to 140° F.

* * * * *